US006491530B2

(12) United States Patent
Koide et al.

(10) Patent No.: US 6,491,530 B2
(45) Date of Patent: Dec. 10, 2002

(54) CONNECTOR AND A METHOD FOR MOUNTING A CONNECTOR

(75) Inventors: Takashi Koide, Yokkaichi (JP); Masahiko Aoyama, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/026,116

(22) Filed: Dec. 21, 2001

(65) Prior Publication Data

US 2002/0106917 A1 Aug. 8, 2002

(30) Foreign Application Priority Data

Dec. 22, 2000 (JP) ..... 2000-391314

(51) Int. Cl.[7] ..... H01R 4/66

(52) U.S. Cl. ..... 439/92; 439/578; 439/939

(58) Field of Search ..... 439/92, 95, 98, 439/101, 102, 578, 607, 609, 108, 939, 608, 610

(56) References Cited

U.S. PATENT DOCUMENTS

| | | | | |
|---|---|---|---|---|
| 5,722,841 A | * | 3/1998 | Wright | 439/98 |
| 6,083,048 A | * | 7/2000 | Yamaguchi | 439/608 |
| 6,171,150 B1 | * | 1/2001 | Saito et al. | 439/610 |
| 6,384,335 B1 | * | 5/2002 | Saito et al. | 174/74 R |

* cited by examiner

*Primary Examiner*—P. Austin Bradley
*Assistant Examiner*—Ross Gushi
(74) *Attorney, Agent, or Firm*—Anthony J. Casella; Gerald E. Hespos

(57) ABSTRACT

A connector (10) has an improved operability by reducing an insertion resistance of a shielding terminal. The connector (10) has a housing (20) and a ground terminal (50). Contact pieces (56) of the ground terminal (50) are movable between a retracted position and a contact position and can be locked at the respective positions. A shielding terminal (15) can be inserted into the housing (20) at the retracted position where the contact pieces (56) and the shielding terminal (15) do not interfere with each other. Thus, an insertion resistance of the shielding terminal (15) can be reduced. Therefore, an assembling operability of the connector (10) can be improved.

14 Claims, 16 Drawing Sheets

CONNECTOR AND A METHOD FOR MOUNTING A CONNECTOR

BACKGROUND OF THE INVENTION

1. Field of the Invention The invention relates to a connector with a shielding terminal and to a method for mounting such a connector.

2. Description of the Related Art

A connector with a shielding terminal is disclosed in Japanese Unexamined Patent Publication No. 8-96895 and is identified by the numeral 1 in FIG. 17 herein. The connector 1 includes a housing 2 and a ground terminal 3 that are mounted on an electrically conductive panel P. The housing 2 is formed with a cavity 2A, and a shielding terminal 4 is accommodated in the cavity 2A. The ground terminal 3 has two opposed contact pieces 3A that extend into the cavity 2A to establish contact with left and right side surfaces of a shielding shell 4A of the shielding terminal 4. The ground terminal 3 then shorts the shielding shell 4A to the panel P.

The leading ends of the contact pieces 3A constantly project into the cavity 2A. Thus, these leading ends and the side surfaces of the shielding shell 4A are held in sliding contact with each other during insertion of the shielding terminal 4. This sliding contact increases insertion resistance of the shielding terminal 4 and results in a poor operability.

In view of the above, an object of the present invention is to provide a connector and a method for mounting a connector allowing for an improved operability by reducing an insertion resistance of a shielding terminal.

SUMMARY OF THE INVENTION

The invention is directed a connector with a housing and a shielding terminal mounted in the housing. The shielding terminal comprises a shielding shell that substantially surrounds an inner terminal. The connector further comprises a ground terminal mounted to the housing. The ground terminal shorts the shielding shell to an electrically conductive fixed article. The ground terminal comprises a contact piece that is movable between a retracted position where it is not in contact with the shielding shell and a contact position where it is in contact with the shielding shell. The shielding terminal can be mounted into the housing when the contact piece is in the retracted position. Accordingly, an insertion resistance of the shield terminal can be reduced.

Both the housing and the ground terminal preferably are formed with mount holes through which a mounting member is inserted to fix the connector to the fixed article. The mount holes of the housing and the ground terminal preferably are not aligned when the contact piece is at the retracted position, but are substantially aligned when the contact piece is at the contact position.

The mounting member cannot fix the connector to the fixed article if the mount holes of the ground terminal and the housing are not aligned. Therefore an operator is reminded to move the ground terminal to the contact position.

A leading end of the contact piece preferably is at a detecting portion of the housing when the contact piece is at the retracted position and can be detected from the outside. Thus, an operator can determine whether the contact piece is at a proper position by projecting a light for photoelectric detection.

The contact piece preferably comprises a slanted portion that projects towards a cavity into which the shielding shell is insertable. Similarly, the housing comprises a slanted surface that corresponds to the slanted portion of the contact piece and that has substantially the same inclination as the slanted portion.

The ground terminal preferably can lock the shielding terminal in the housing when the ground terminal is being mounted on the housing.

The shielding terminal preferably is locked partly in the housing by a partly locking means and is locked fully in the housing by the ground terminal.

Most preferably, the ground terminal is mounted on the housing for movement between a first position where insertion and withdrawal of the shielding terminal are permitted and a second position where the ground terminal locks the shielding terminal.

The invention also is directed to a method for mounting a connector for fixing a shielding shell of a shielding terminal to an electrically conductive fixed article. The method comprises assembling a ground terminal to a housing of the connector for bringing the ground terminal into shorting contact with both the shielding shell and the fixed article, and moving at least one contact piece of the ground terminal between a retracted position where it is not in contact with the shielding shell and a contact position where it is in contact with the shielding shell.

The method may further comprise inserting a mounting member through mount holes formed in both the housing and the ground terminal to fix the connector to the fixed article.

Preferably, the mount holes of the housing and the ground terminal are not aligned when the contact piece is at the retracted position, but are substantially aligned when the contact piece is at the contact position.

The method may further comprise detecting whether the contact piece is in contact with the shielding shell by verifying whether a portion of the contact piece is in a detecting portion of the housing.

These and other objects, features and advantages of the present invention will become apparent upon reading of the following detailed description of preferred embodiments and accompanying drawings.

DETAILED DESCRIPTION OF THE PREFERRED EMBODIMENTS

Figure 1:
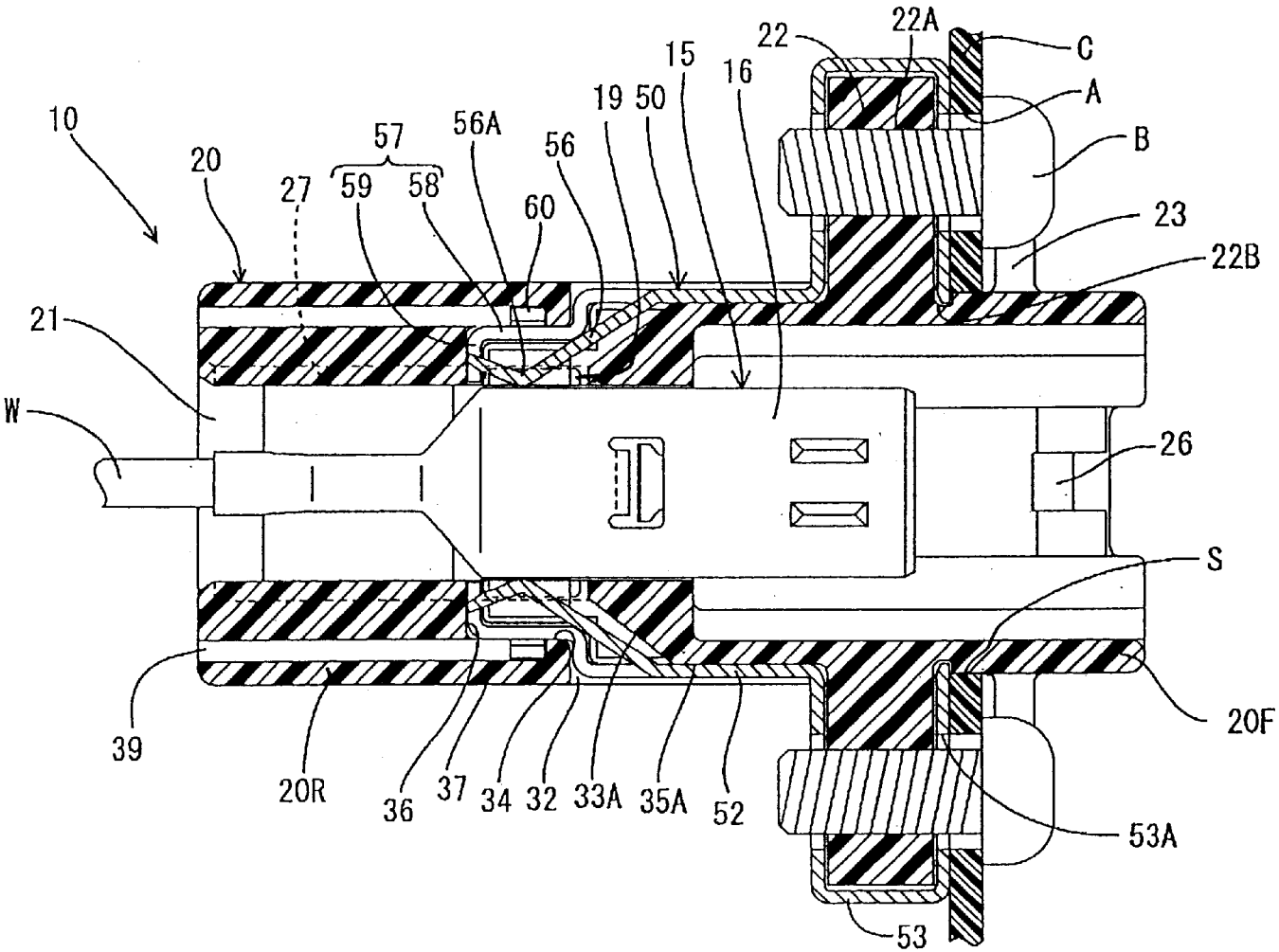
FIG. 1 is a section of a connector according to the invention.
Figure 2:
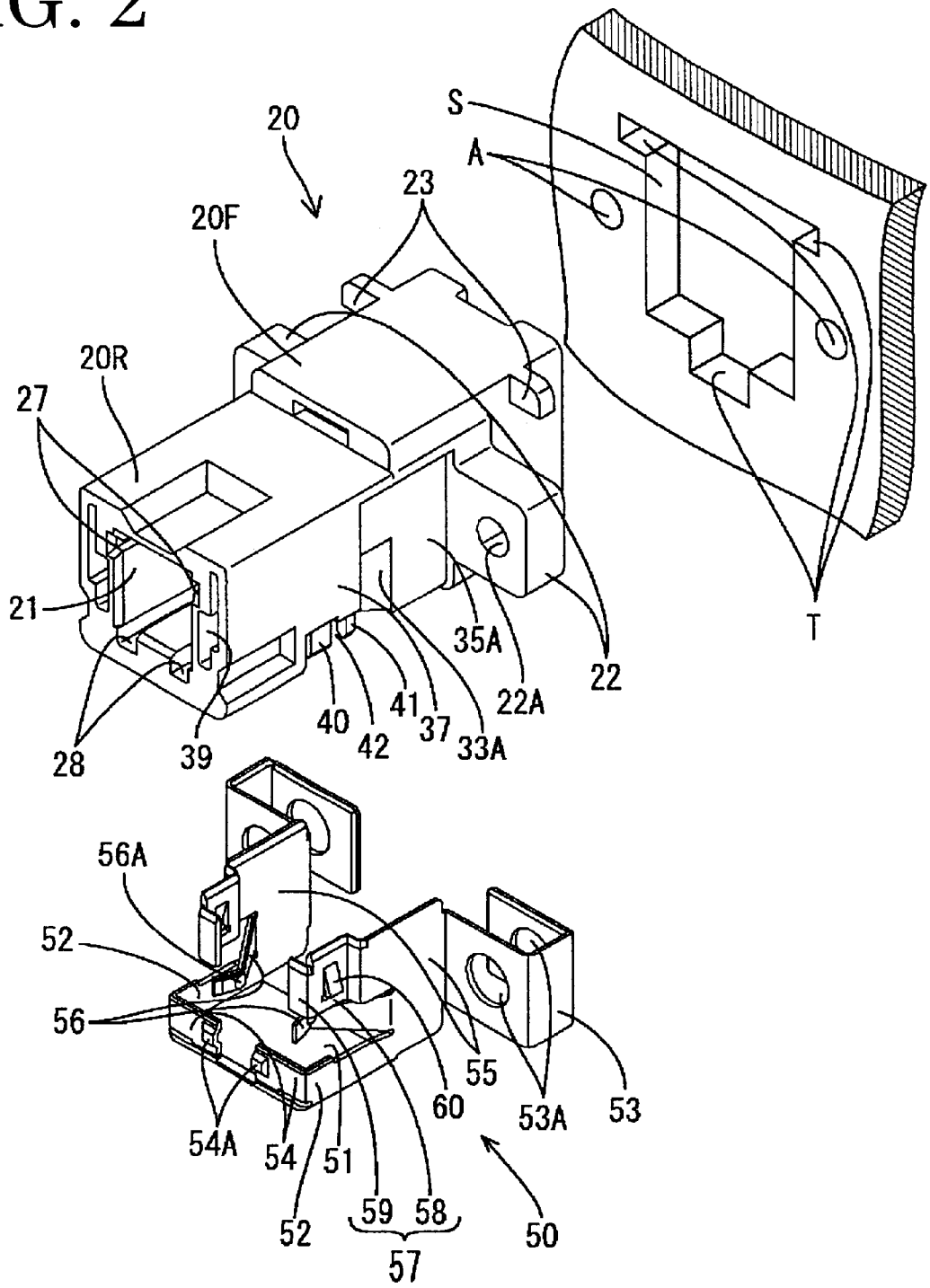
FIG. 2 is an exploded perspective view of the connector.
Figure 4:
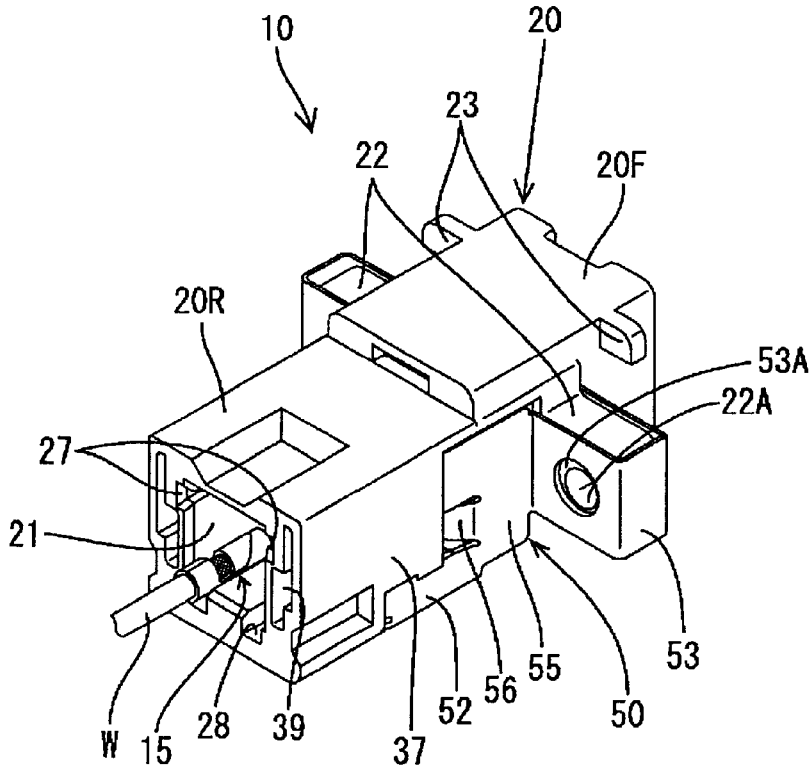
FIG. 4 is a perspective view of the connector with the ground terminal mounted at a full locking position.

A connector in accordance with the invention is identified by the numeral 10 and is assembled into a shielded casing C as shown in FIGS. 1 and 4. The shielded casing C is formed substantially into a box shape from an electrically conductive plate material and has a mounting surface. The mounting surface is formed with an opening S through which the connector 10 is insertable, and escaping portions T bulge out at substantially opposite lateral edges and the bottom edge of the opening S. Mount holes A extend through the mounting surface at locations spaced from the opening S for fixing the connector 10 as shown in FIG. 2.

Figure 9:
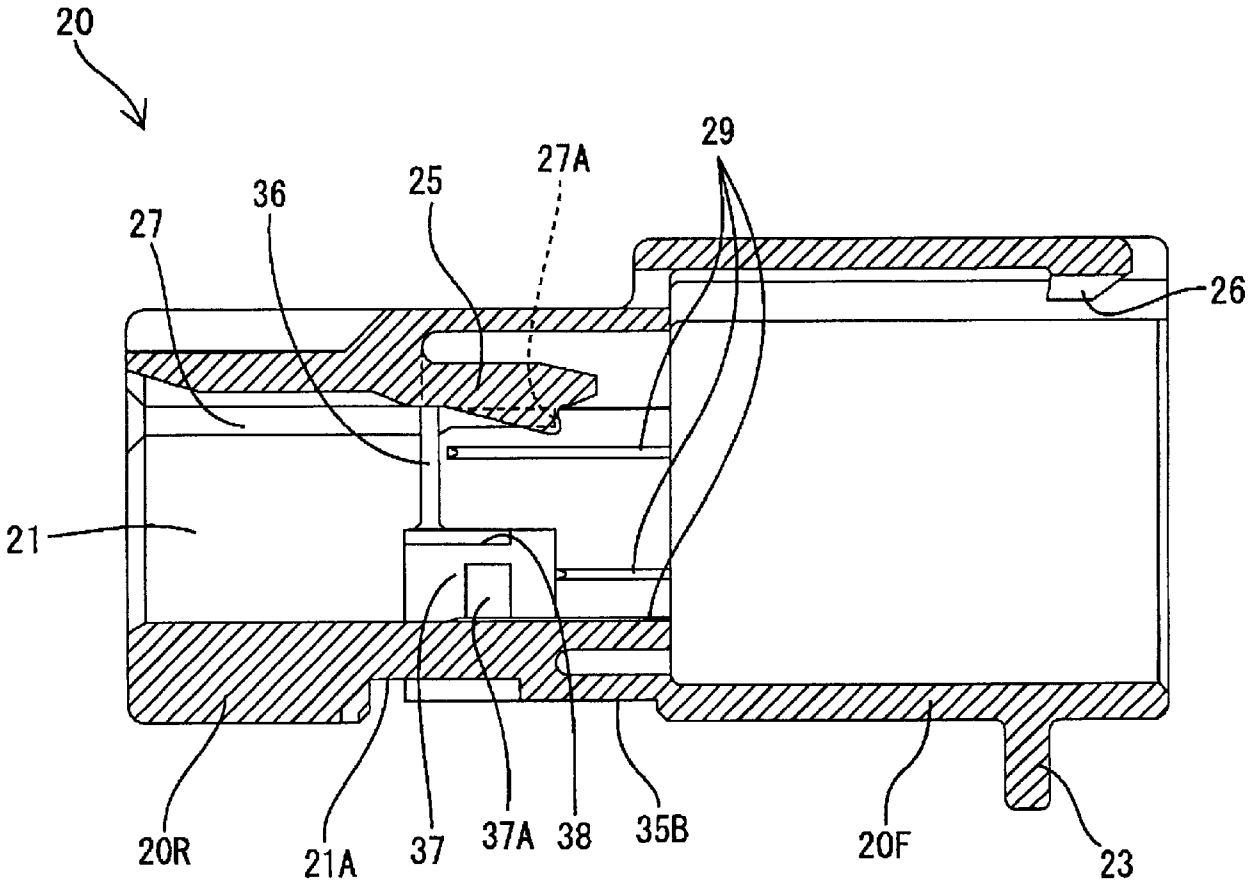
FIG. 9 is a side view in section of the housing.
Figure 10:
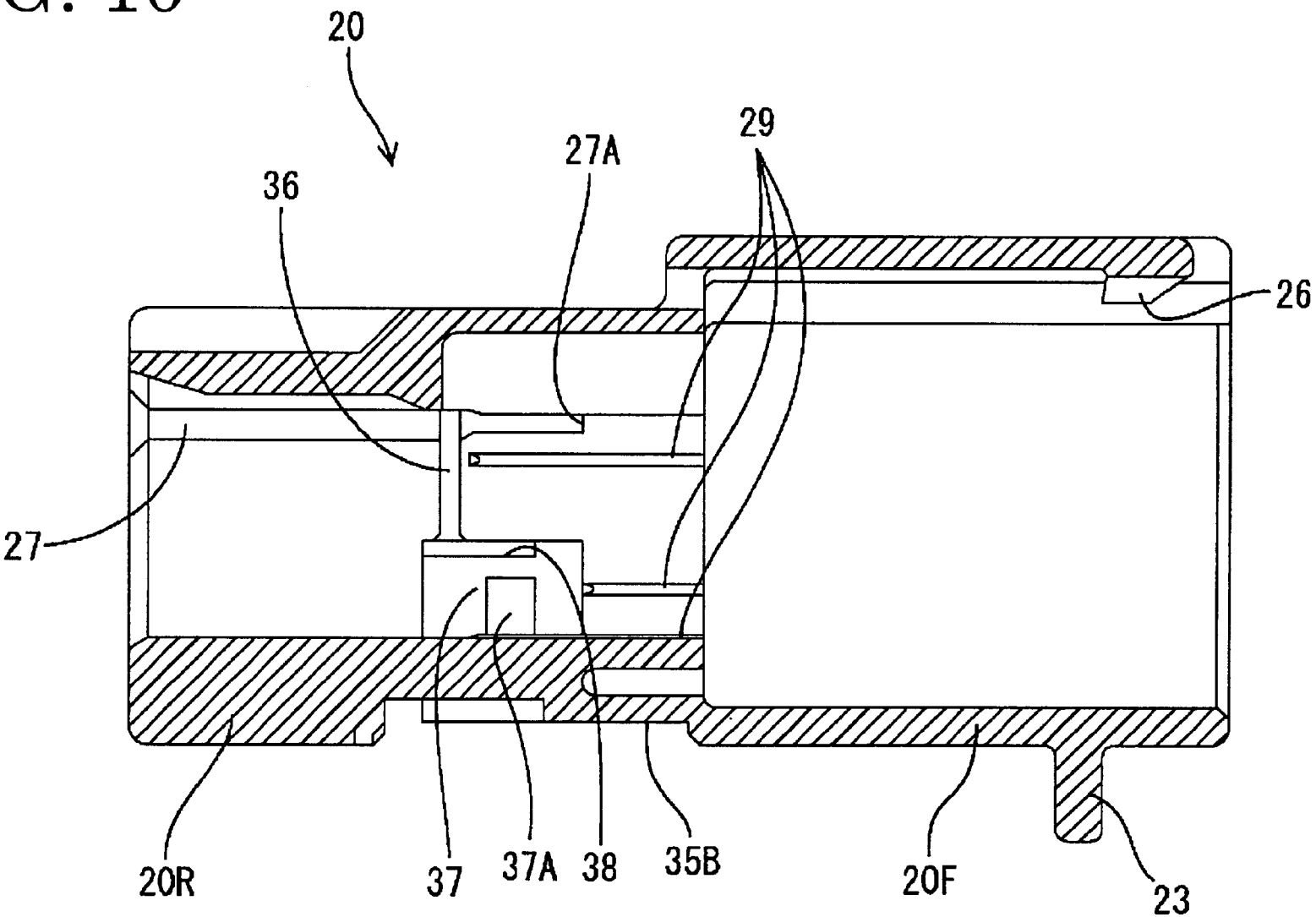
FIG. 10 is a side view in section of the housing at an other position.
Figure 11:
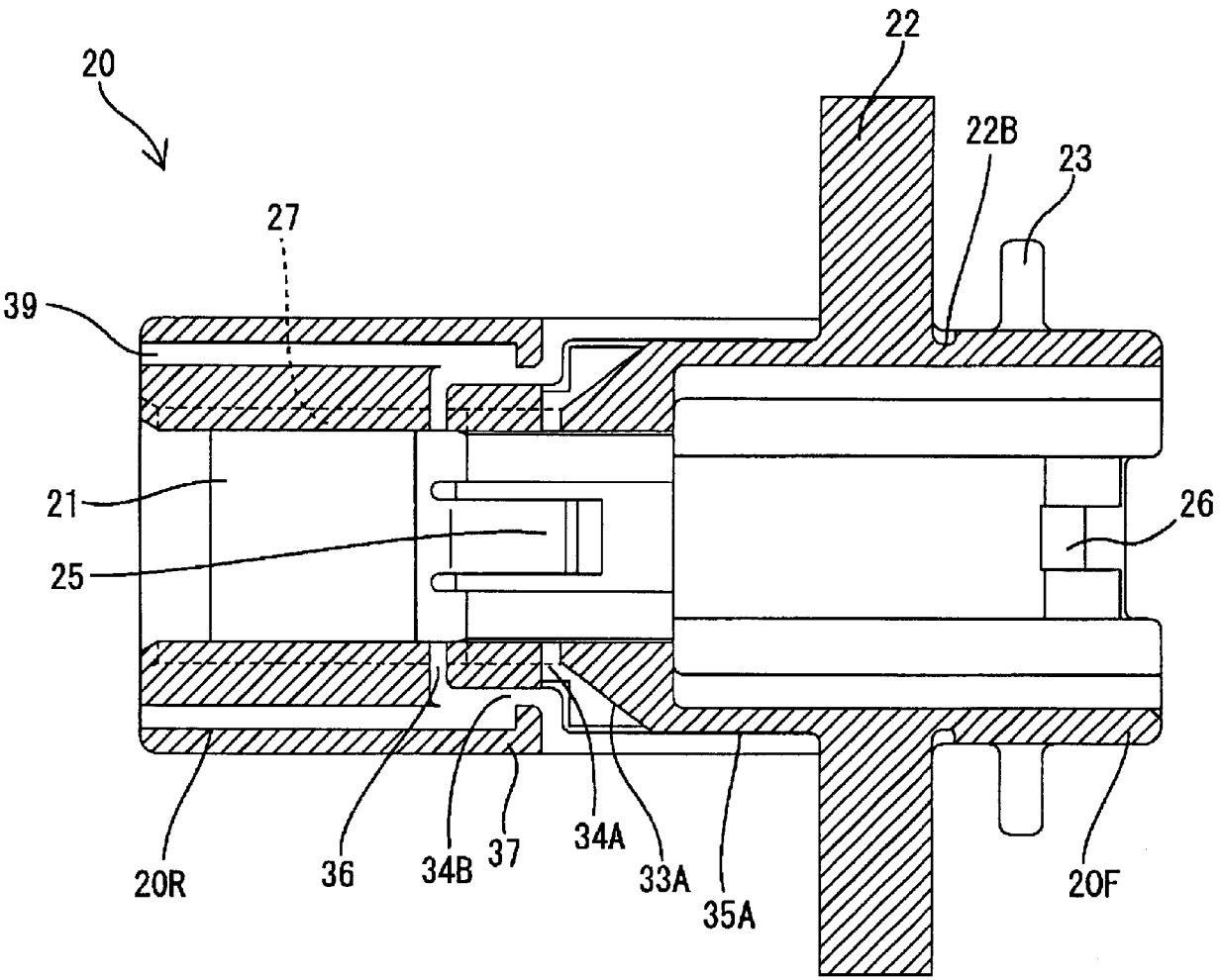
FIG. 11 is a plan view in section of the housing.

The connector 10 has a housing 20 formed integrally or unitarily of a synthetic resin material. A receptacle 20F is provided at the front of the housing 20, as shown in FIG. 9, and defines a rectangular tube that opens forward toward a mating connector (not shown). Bulging portions 23 are formed on outer surfaces of the receptacle 20F at each of the left and right side walls and substantially in the middle of a bottom wall 51 near the opening edge. The receptacle 20F of the housing 20 is partly insertable into the shielded casing C by aligning the respective bulging portions 23 with the corresponding escaping portions T. The connector 10 is held in the shielded casing C by displacing the inserted housing 20 down in FIGURES to engage the respective bulging portions 23 with the opening edges of the escaping portions T.

The receptacle 20F is formed to receive an unillustrated mating connector, and a housing lock 26 is formed on the ceiling of the receptacle 20F for locked engagement with the mating connector. A fixing piece 22 bulges out from each of the left and right side walls of the receptacle 20F at a position displaced from the corresponding bulging portion 23 by a distance slightly longer than the thickness of the shielded casing C. The fixing pieces 22 can be brought into contact with the wall surfaces of the shielded casing C and are formed with fixing holes 22A that correspond to the mount holes A of the shielded casing C. Insertion grooves 22B are formed in the side walls of the receptacle 20F at locations forward of and adjacent the fixing pieces 22.

A terminal holding portion 20R is provided in the housing 20 substantially continuously with the receptacle 20F, and a substantially rectangular cavity 21 penetrates the terminal holding portion 20R substantially in forward and backward directions. An elastically or resiliently deformable lock 25 is cantilevered from the ceiling surface of the cavity 21.

A shielding terminal 15 is connected with the leading end of a known shielded wire or cable W that has a core in the center, an insulating layer around the core, a shield layer around the insulating layer, and a sheath as an outermost layer. The shielding terminal 15 has a shielding shell 16, an inner terminal 17 connected with the core and disposed within the shielding shell 16 and a dielectric element 18 between the inner terminal 17 and the shielding shell 16.

Figure 3:
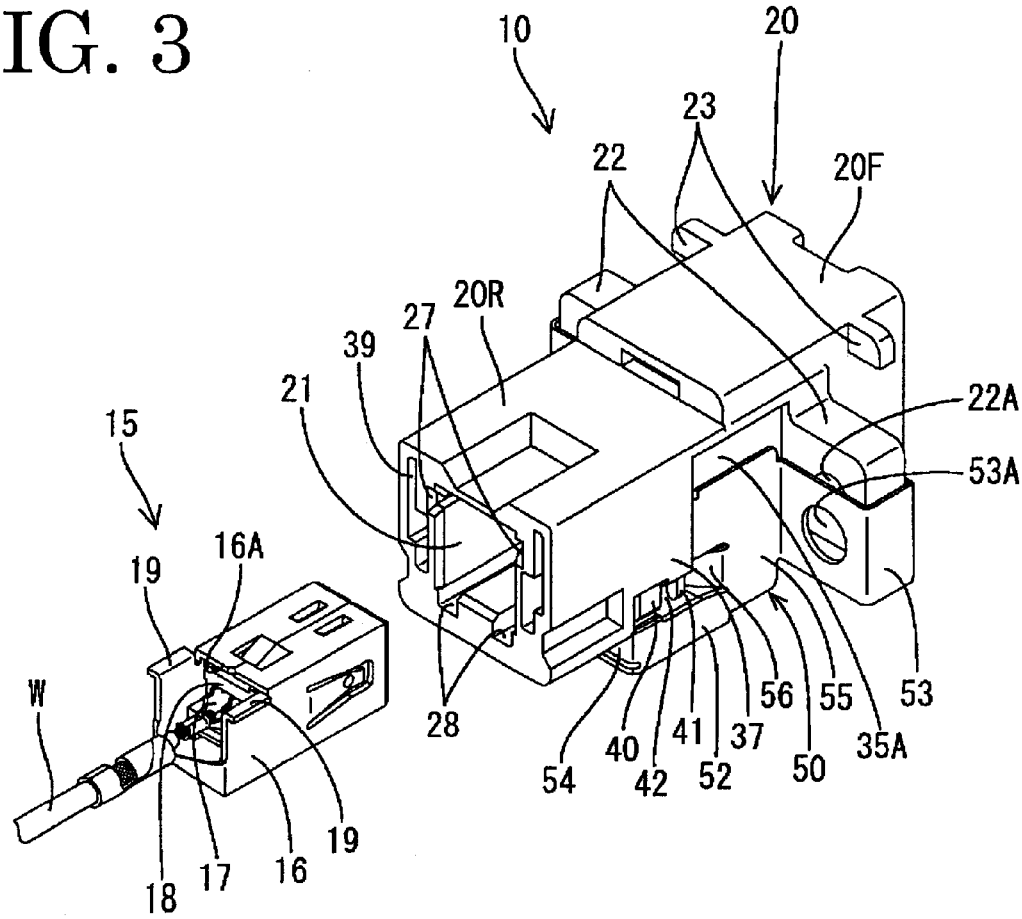
FIG. 3 is a perspective view of the connector with a ground terminal mounted at a partial locking position.

A rear portion of the ceiling wall of the shielding shell 16 is open, as shown in FIG. 3, and the front of the open portion defines a locking edge 16A for engagement with the lock 25. Opposite side ends of the open portion are bent outwardly to form a pair of stabilizers 19.

Two guide grooves 27 are formed in the cavity 21, as shown in FIG. 9, to receive the stabilizers 19 and to guide movement of the shielding terminal 15. The guide grooves 27 extend longitudinally from the rear end of the cavity 21 to substantially the same position as the leading end of the lock 25. Rear ends of the guide grooves 27 are closed and define contacts 27A for contacting the stabilizers 19. The guide grooves 27 are narrower near the rear end than at the entrance. Thus, the stabilizers 19 can be inserted into the wide entrance of the guide groove 27 with a small insertion force. However, the fully inserted stabilizers 19 can be held without shaking in the narrower rear part of the guide grooves 27.

Detection grooves 28 are formed at the opposite sides of the bottom surface of the cavity 21 and over the entire length of the cavity 21.

Figure 5:
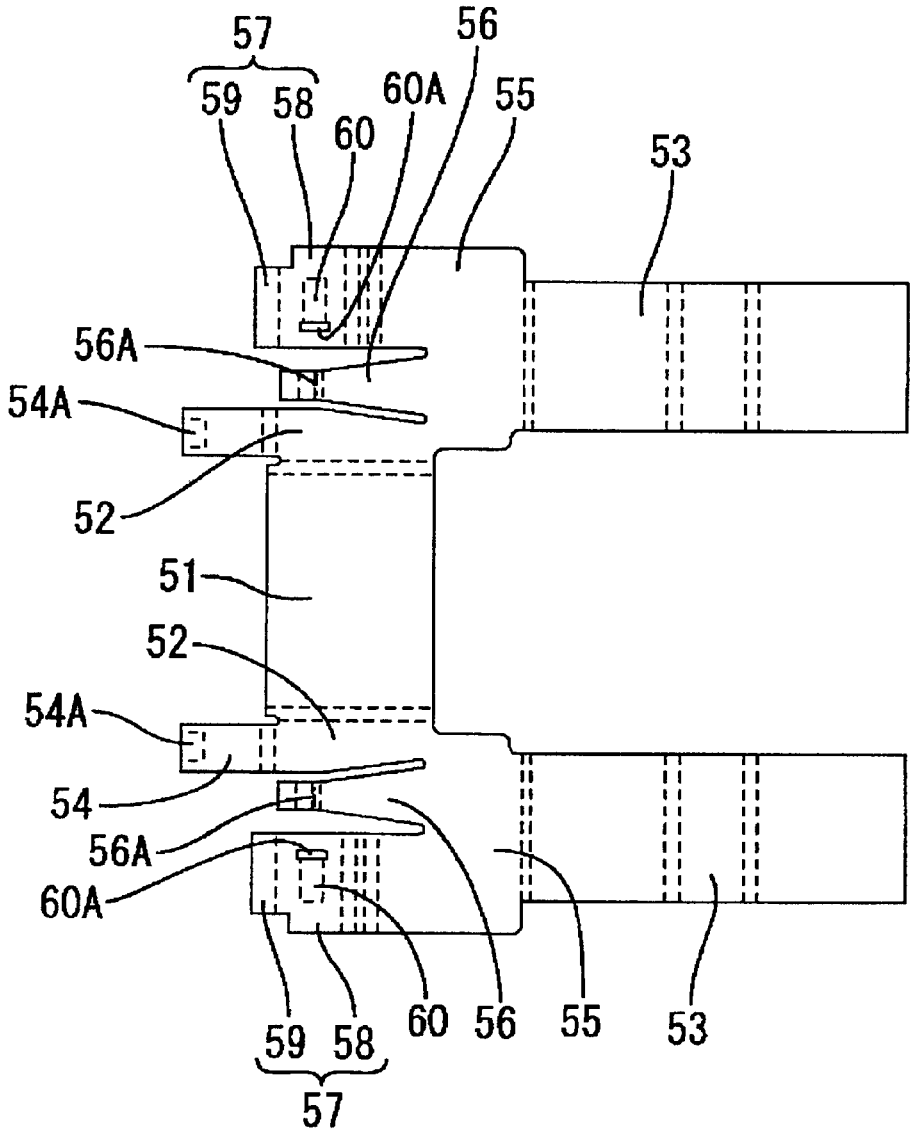
FIG. 5 is a development of the ground terminal.
Figure 6:
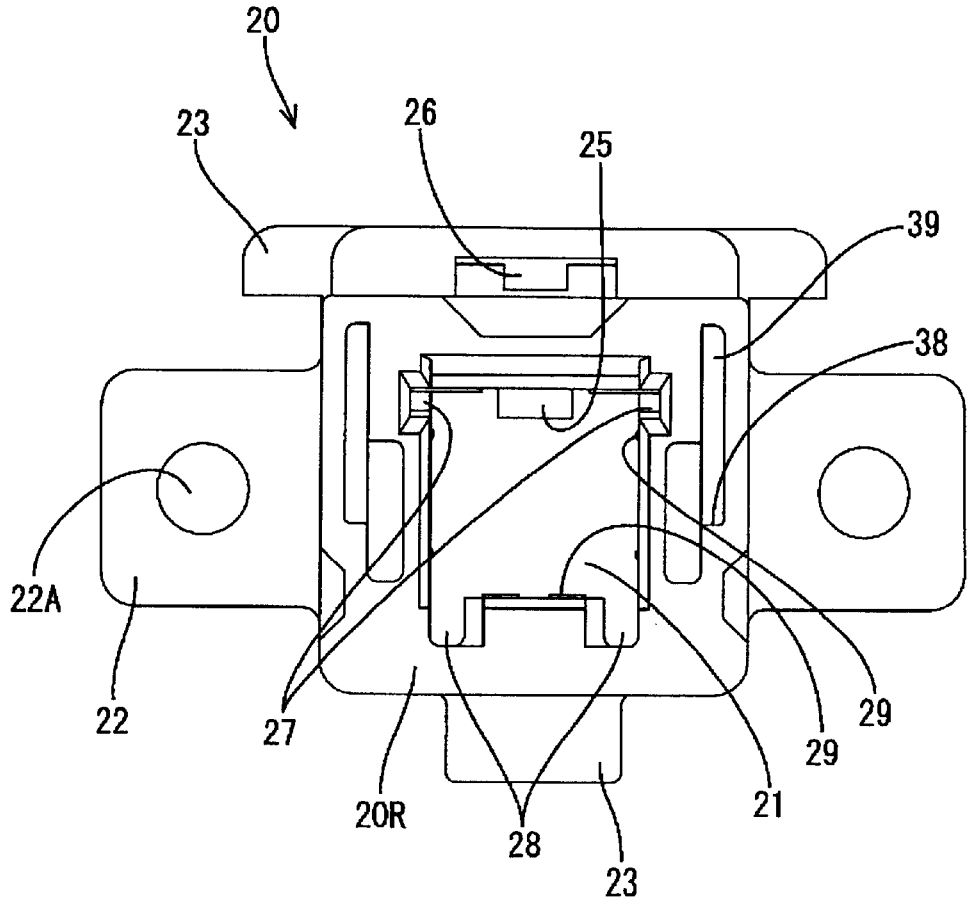
FIG. 6 is a rear view of a housing.

The connector 10 further includes a ground terminal 50 that is formed from an electrically conductive metallic plate, as shown in FIG. 5. The plate is stamped, bent, folded and/or embossed to form the ground terminal 50, as shown in FIG. 2. The ground terminal 50 has a bottom wall 51 and lateral walls 52 that project from the bottom wall 51. The lateral walls 52 have their rear ends bent inward along the rear end of the bottom wall 51 to form a pair of elastically or resiliently deformable full locking pieces 54. Full locking projections 54A project at opposed ends of the full locking pieces 54. The full locking projections 54A engage edges of mount holes 31 of the housing 20 when the ground terminal 50 is at the partial locking position shown in FIG. 14 to provide partial restriction against further insertion of the ground terminal 50 into the housing 20. The full locking projections 54A can enter and lock in the detection grooves 28 of the housing 20 when the ground terminal 50 is at the full locking position of FIG. 15.

Standing walls 55 are substantially opposed to each other at ends of the lateral walls 52 opposite from the full locking pieces 54 (see FIG. 2). A U-shaped surrounding piece 53 bulges outwardly from each standing wall 55 and is oriented so that the U-shape opens open inwardly. The surrounding pieces 53 are dimensioned and disposed to engage the fixing pieces 22. A through hole 53A is formed in each surrounding piece 53 for alignment with the corresponding fixing hole 22A when the surrounding pieces 53 are engaged properly with the fixing pieces 22, as shown in FIG. 4.

An engaging piece 57 is formed at an upper end of each standing wall 55 substantially opposite from the surrounding piece 53, as shown in FIG. 2. The engaging pieces 57 extend inwardly in steps and opposing pieces 58 are formed at positions one step in from the standing walls 55. A locking claw 60 is formed substantially in the middle of each opposing piece 58 by punching oblong holes 60A in the opposing pieces 58 so that the bottom ends of the locking claws 60 straight and by cutting and/or bending the punched portions. The locking claws 60 engage the housing 20 to hold the entire ground terminal 50 at its partial locking position.

Leading ends of the opposing pieces 58 are bent inwardly at substantially right angles to form resiliently deformable touching pieces 59. The upper ends of the touching pieces 59 are cut off so that the touching pieces 59 are narrower than the opposing pieces 58.

A resiliently deformable contact piece 56 cantilevers from each standing wall 55 at a location between the lateral wall 52 and the engaging piece 57, as shown in FIG. 2. The contact pieces 56 can be brought resiliently into contact with side surfaces of the shielding shell 16 of the shielding terminal 15 accommodated in the cavity 21, as shown in FIG. 1. The two contact pieces 56 extend inwardly so that the space between the contact pieces 56 gradually decreases. Additionally, the contact pieces 56 are narrowed gradually from their bases toward their leading ends. The leading ends of the contact pieces 56 are bent outwardly to form a substantially V-shape and define contact leading end portions 56A for contacting the shielding terminal 15 (see FIG. 1).

Figure 7:
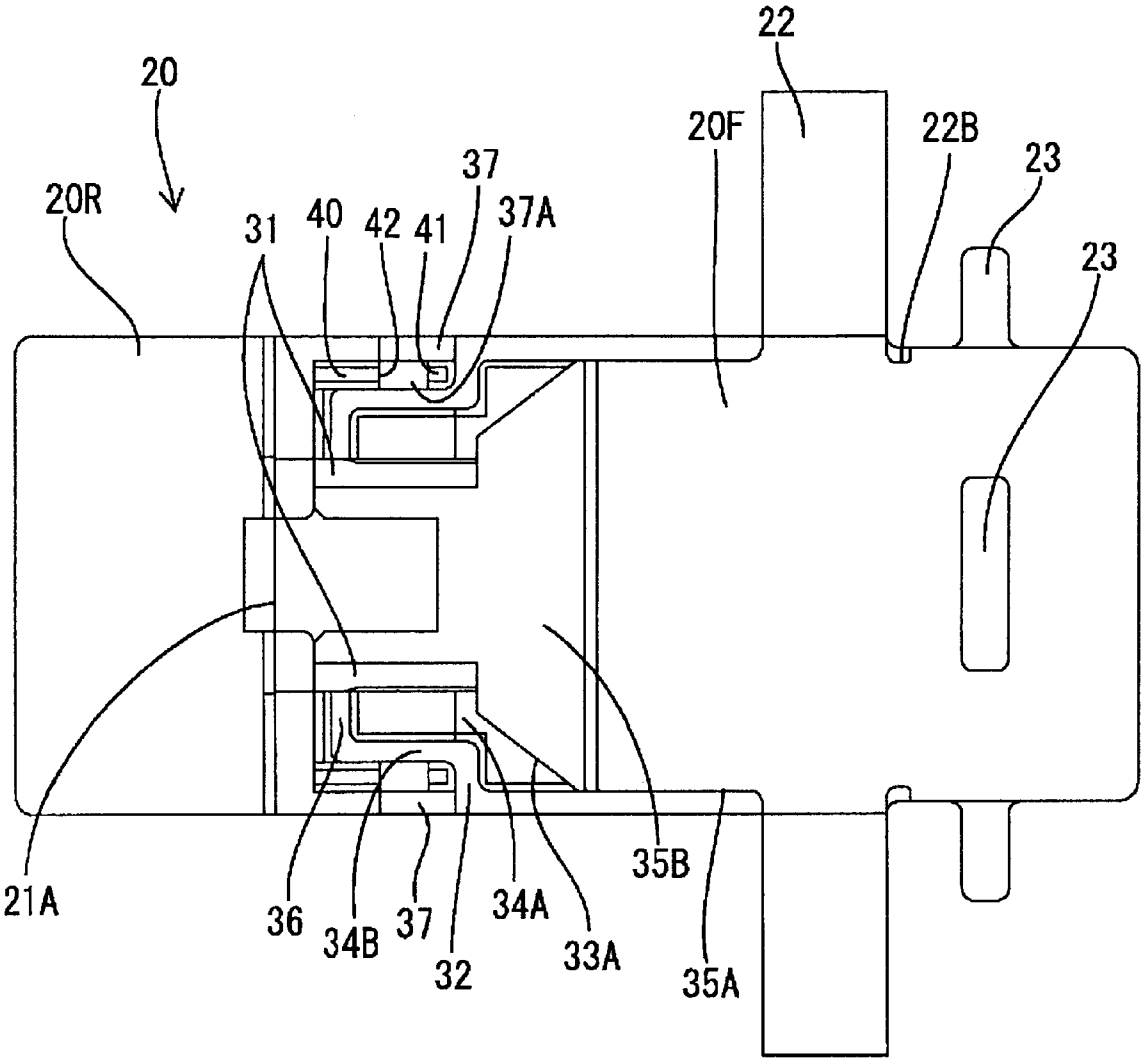
FIG. 7 is a bottom view of the housing.
Figure 8:
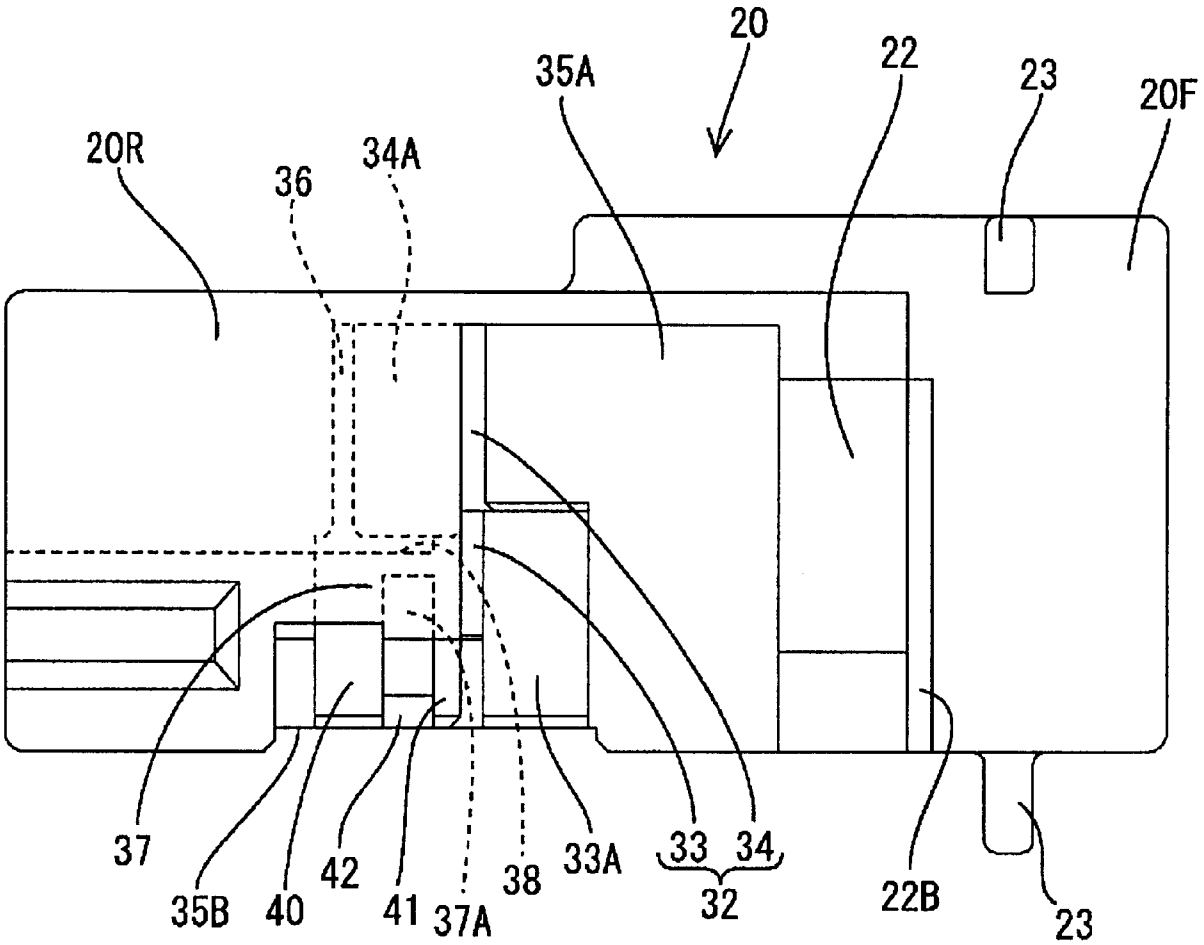
FIG. 8 is a side view of the housing.

As shown in FIG. 7, the mount holes 31 for mounting the ground terminal 50 are formed at the left and right sides of the bottom surface of the terminal holding portion 20R of the housing 20 and communicate with the cavity 21. Opposite lateral walls of the terminal holding portion 20R have vertical insertion slits 32 that extend continuously with the mount holes 31 to avoid interference with the terminal holding portion 20R when the ground terminal 50 is mounted in the mount holes 31. Areas of the bottom surface and the side surfaces of the terminal holding portion 20R adjacent the mount holes 31 and the insertion slits 32 are recessed by the thickness of the ground terminal 50 to form lateral stepped portions 35A and a bottom stepped portion 35B. Thus the surrounding surfaces and the outer surfaces of the ground terminal 50 are substantially flush with each other when the ground terminal 50 is mounted.

A hook-shaped extending wall 34A is formed at one opening edge of an upper half 34 of the slit 32 of each lateral stepped portion 35A, and extends substantially parallel with a corresponding side wall 37 of the terminal holding portion 20R inside the housing 20, as shown in FIG. 7. Thus, stepped grooves 34B are formed between the side walls 37 of the terminal holding portion 20R and the cavity 21 and conform with the shape of the engaging pieces 57 of the ground terminal 50. The rear ends of the stepped grooves 34B define hooking portions 36 for accommodating the touching pieces 59. The hooking portions 36 of the stepped grooves 34B communicate with the guide grooves 27 for the stabilizers 19 substantially at right angles, as shown in FIG. 9.

Lower halves 33 of the slits 32 penetrate the cavity 21 through openings, so that the contact pieces 56 of the ground terminal 50 can be introduced into the cavity 21. One opening edge of the slit 32 in each lower half 33 is formed on the outer wall surface and is sloped down toward the slit 32 to conform to the inclination of the contact piece 56.

Receiving pieces 40 are formed at the side walls 37 of the terminal holding portion 20R adjacent the opening edges of the mount holes 31 and closely contact inner surfaces of the lateral ends 52 and the full locking pieces 54 of the ground terminal 50. The outer surfaces of the receiving pieces 40 are retracted inwardly from the surrounding surfaces substantially by the thickness of the ground terminal 50. Suspended pieces 41 are formed forward of the receiving pieces 40 and substantially parallel therewith. However, clearances 42 are defined between the suspended pieces 41 and the receiving pieces 40 to avoid interference with the locking claws 60 on the opposing pieces 58 when the ground terminal 50 is mounted into the housing 20.

Figure 12:
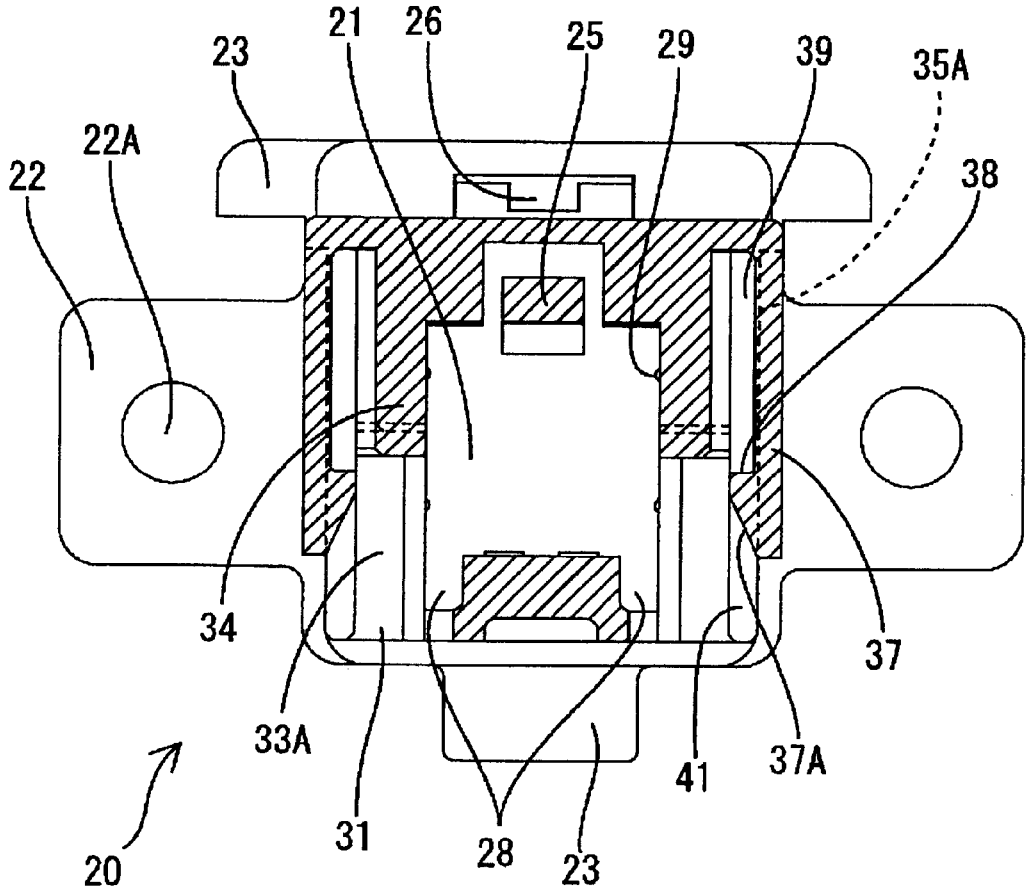
FIG. 12 is a section of the housing.

Slanted surfaces 37A are formed on the inner surfaces of the side walls 37 of the terminal holding portion 20R continuous with the upper parts of the clearances 42. Stepped surfaces 38 are formed continuously with the slanted surfaces 37A, as shown in FIG. 12, by using mold-removing holes in the rear of the terminal holding portion 20R. Accordingly, the locking claws 60 deform along the slanted surfaces 37A during mounting of the ground terminal 50 and are resiliently restored to engage the stepped surfaces 38 after sufficient mounting of the ground terminal 50. In this way, the ground terminal 50 is held at its partial locking position.

Figure 13:
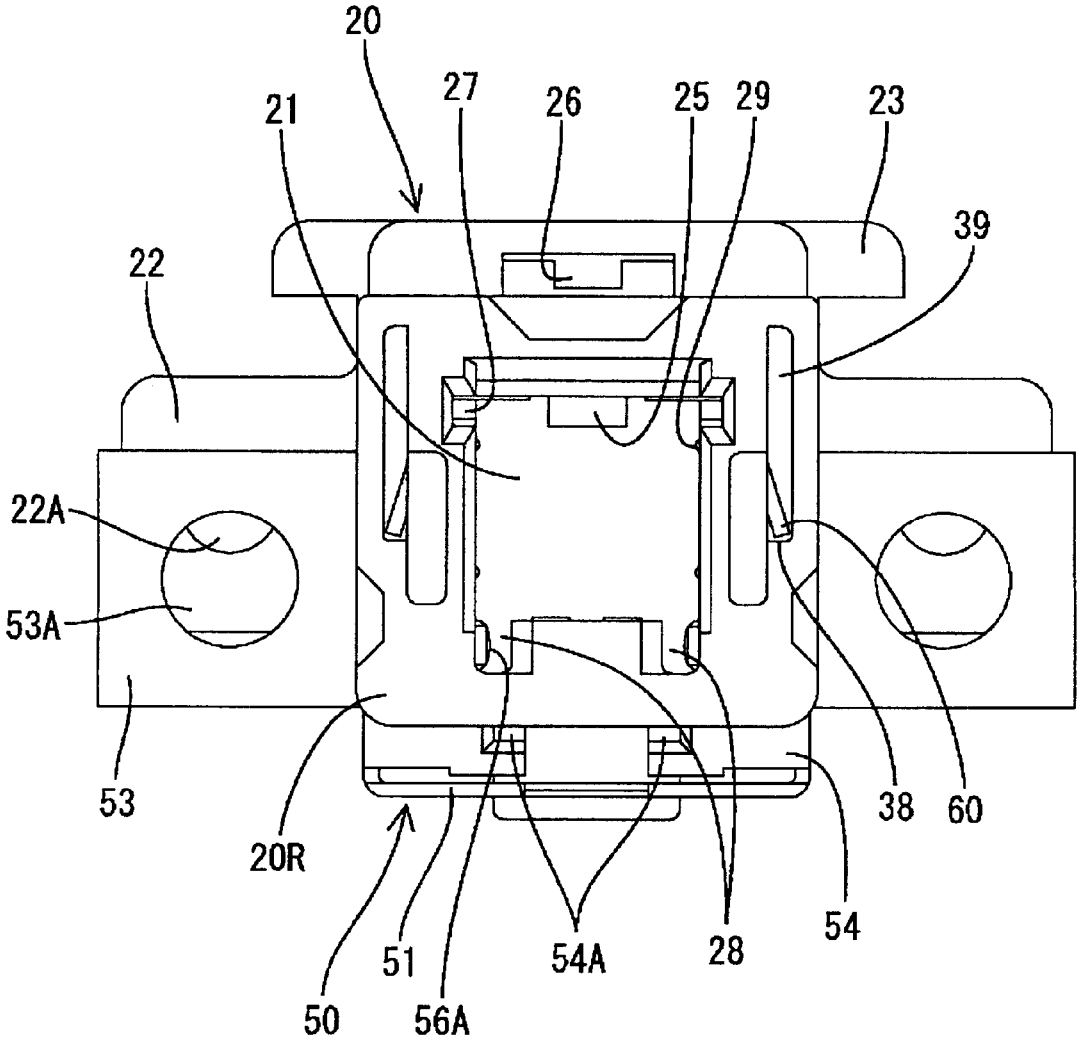
FIG. 13 is a rear view of the connector with the ground terminal mounted at the partial locking position.
Figure 14:
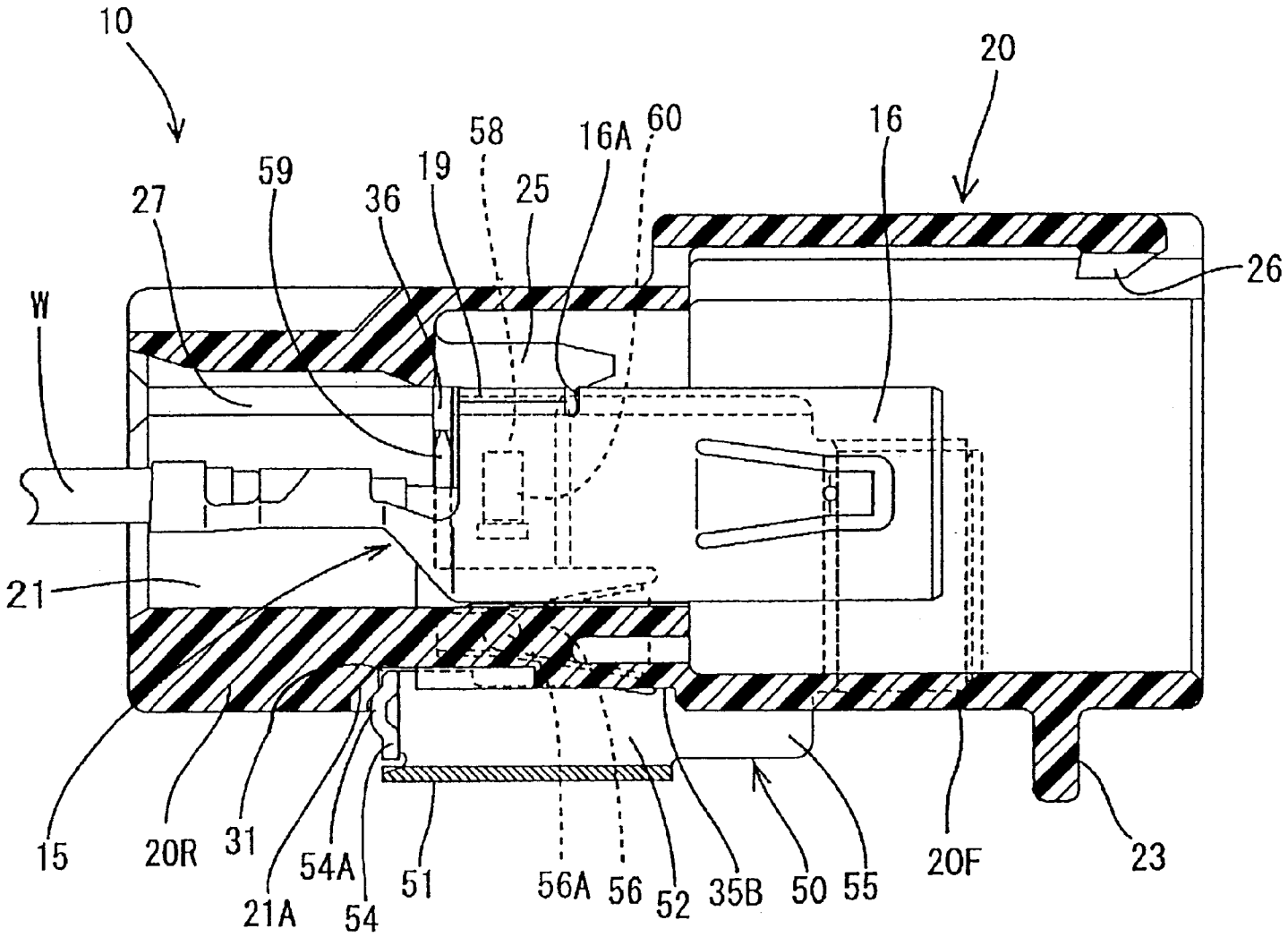
FIG. 14 is a side view in section of the connector when a shielding terminal is inserted with the ground terminal mounted at the partial locking position.
Figure 15:
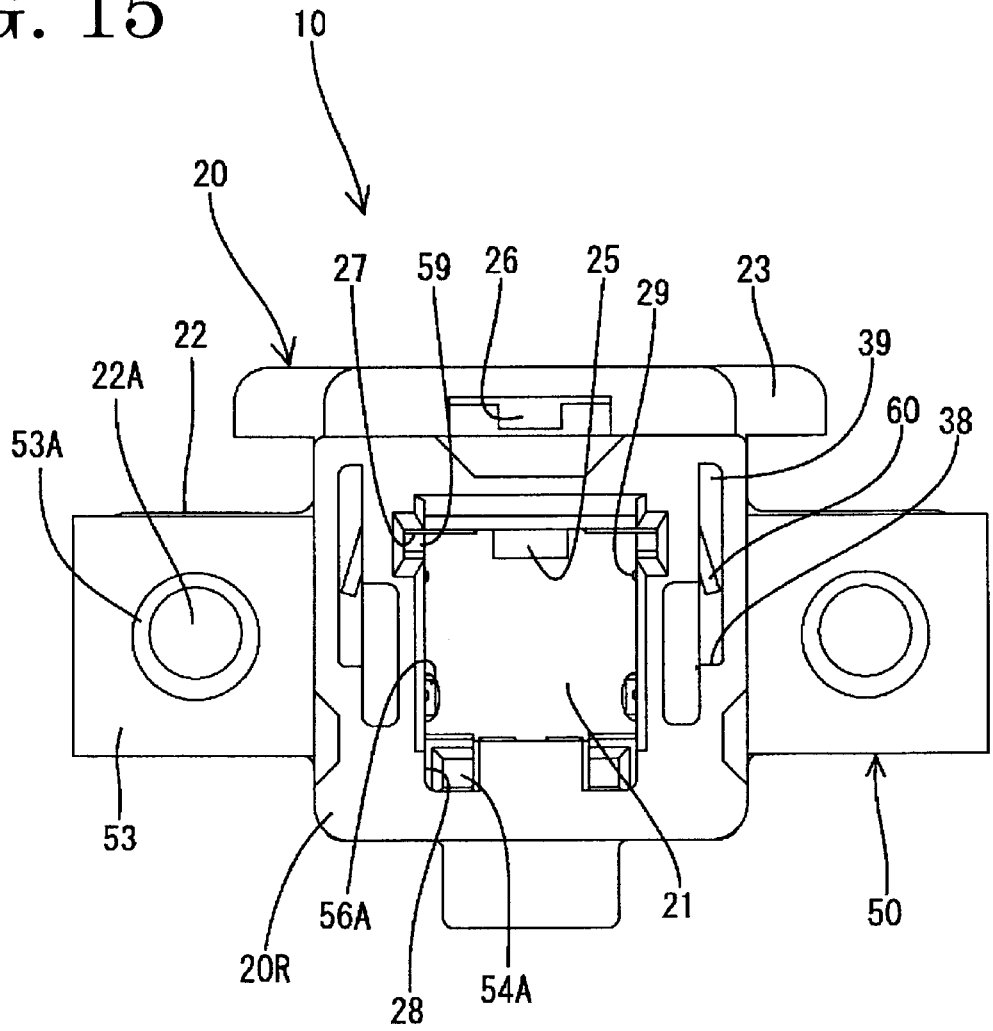
FIG. 15 is a rear view of the housing with the ground terminal mounted at the full locking position.

The connector 10 is assembled by first aligning the surrounding pieces 53 of the ground terminal 50 with the fixing pieces 22 of the housing 20 and inserting the leading ends of the surrounding pieces 53 into the insertion grooves 22B. Simultaneously, the engaging pieces 57 align with the insertion slits 32. The ground terminal 50 is pushed toward the housing 20 in this state. Thus, the locking claws 60 of the engaging pieces 57 pass through the clearances 42 between the suspended pieces 41 and the receiving pieces 40 and are deformed along the slanted surfaces 37A inside the housing 20. Further pushing of the ground terminal 50 moves the contact pieces 56 inside the receiving pieces 40 and the suspended pieces 41, and eventually enables the locking claws 60 to align with the stepped surfaces 38. Thus, the locking claws 60 are restored resiliently and engage the stepped surfaces 38, as shown in FIG. 13. The full locking projections 54A of the ground terminal 50 engage with the edges of the mount holes 31 of the housing 20, at this time, as shown in FIG. 14. Thus the ground terminal 50 cannot be pushed further and is held at the partial locking position where it is prevented from disengagement from the housing 20.

At the partial locking position, the contact pieces 56 of the ground terminal 50 are at their retracted positions where they are at least partly located in the detection grooves 28. However, upper ends of the contact pieces 56 are lower than the bottom wall of the cavity 21 as shown in FIG. 13. Further, the upper ends of the touching pieces 59 of the ground terminal 50 are below the guide grooves 27 in the housing 20. Accordingly, the shielding terminal 15 can be inserted into the cavity 21 without interfering with the ground terminal 50 when the ground terminal 50 is at the partial locking position.

The lock 25 engages the locking edge 16A of the shielding shell 16 when the shielding terminal 15 is inserted to a specified depth in the cavity 21 to achieve partial locking. The elongated projections 29 on the back sides of the left and right surfaces and the bottom surface of the cavity 21 prevent the inserted shielding terminal 15 from shaking in the cavity 21.

The contact leading end portions 56A of the contact pieces 56 are in the detection grooves 28 when the ground terminal 50 is at the partial locking position. Thus, light or laser beams can be projected in the longitudinal direction of the detection grooves 28 and a detector at a receiving end can determine whether the ground terminal 50 is located properly at the partial locking position. Therefore, a mounting error of the ground terminal 50 can be detected based on the detection result. The presence of the contact leading end portions 56A of the contact pieces 56 in the detection grooves 28 also can be detected visually.

Figure 16:
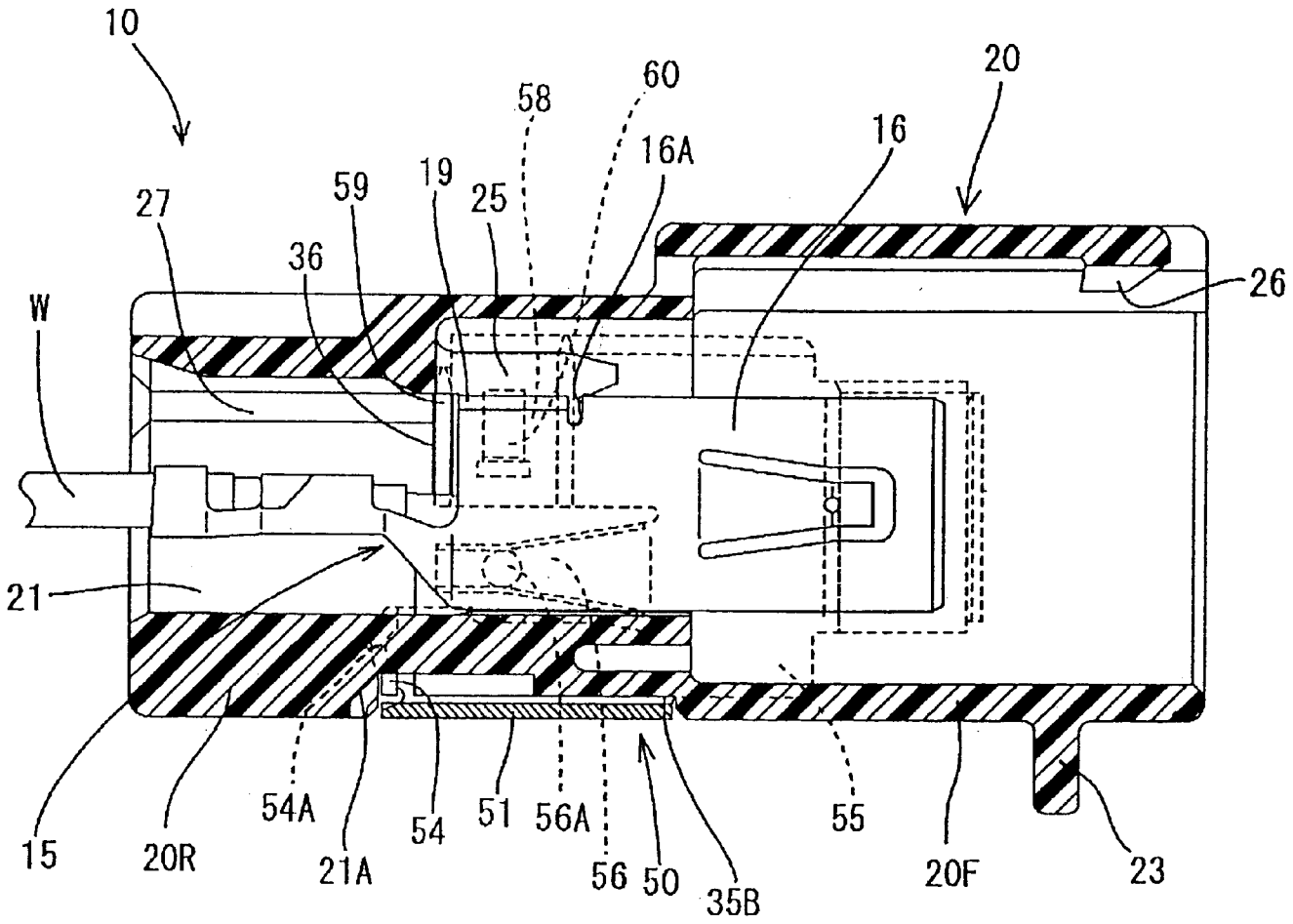
FIG. 16 is a side view in section of the connector in which a shielding terminal is doubly locked.
Figure 17:
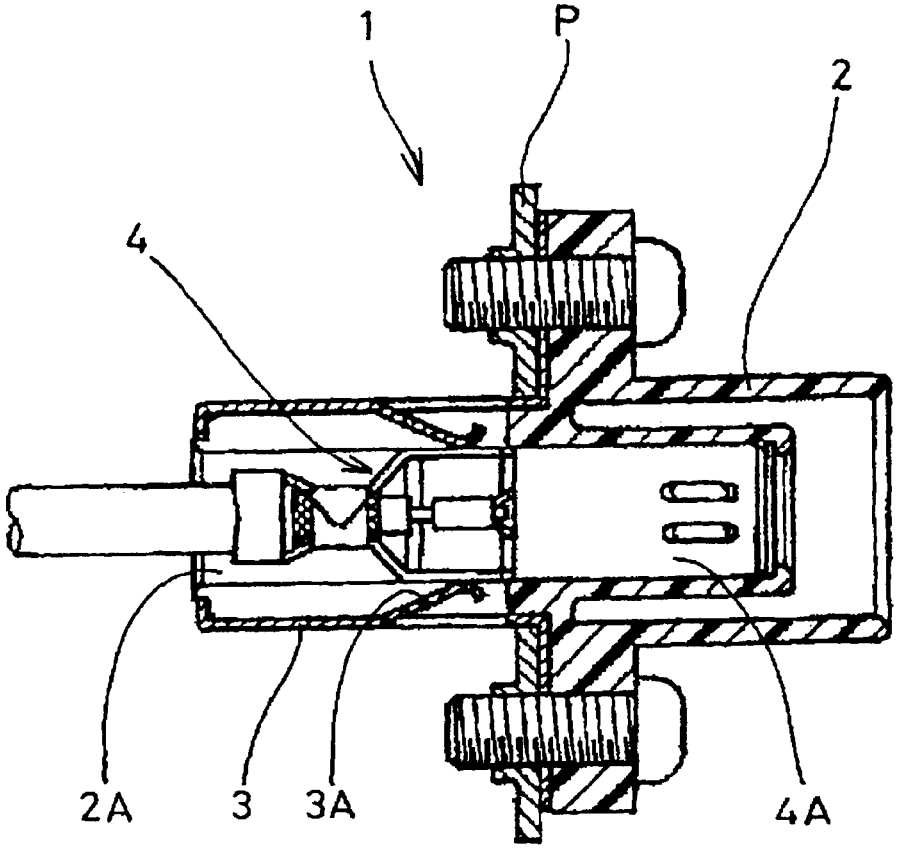
FIG. 17 PRIOR ART
FIG. 17 is a section of a prior art connector.

The ground terminal 50 can be pushed further from the partial locking position. Thus, the full locking pieces 54 are deformed inwardly and the full locking projections 54A are pushed into the mount holes 31. The full locking pieces 54 are restored elastically or resiliently and the full locking projections 54A align with and engage the inner walls of the detection grooves 28. As a result, the entire ground terminal 50 is located at the full locking position as shown in FIG. 16.

The touching pieces 59 enter the guide grooves 27 behind the stabilizers 19 of the shielding terminal 15 when the ground terminal 50 is at the full locking position. Thus, the shielding terminal 15 is prevented from coming out of the cavity 21. In this way, the shielding terminal 15 is locked doubly by the lock 25 and the ground terminal 50.

The ground terminal 50 that has reached the full locking position is in a contact position where the contact leading end portions 56A of the contact pieces 56 contact the left and right side surfaces of the shielding shell 16 of the shielding terminal 15. In this way, the ground terminal 50 and the shielding terminal 15 are connected electrically. The contact pieces 56 contact the shielding shell 16 from left and right sides with elastic or resilient forces at this time. Thus, contact resistance between the ground terminal 50 and the shielding terminal 15 is reduced, and the shielding terminal 15 is prevented from shaking in transverse direction. Further, the upper ends of the full locking pieces 54 contact the bottom surface of the shielding terminal 15 to push it up. Thus, the shielding terminal 15 is prevented from shaking in vertical direction.

If the shielding terminal 15 is not inserted to the proper depth, the stabilizers 19 block the hooking portions 36 of the stepped grooves 34B, which are passages for the touching pieces 59. Thus, the touching pieces 59 cannot enter the guide grooves 27, and an operator can notice the insufficient insertion of the shielding terminal 15 by such an abnormality.

The through holes 53A of the surrounding pieces 53 and the fixing holes 22A of the fixing pieces 22 are aligned when the ground terminal 50 reaches the full locking position with respect to the housing 20. Thus, the entire connector 10 can be mounted into the mount hole A in the wall surface of the shielded casing C by screws B. However, the through holes 53A of the surrounding pieces 53 and the fixing holes 22A of the fixing pieces 22 are not aligned before the ground terminal 50 reaches the full locking position. Thus, the screws B cannot be inserted through the mount holes A, the through holes 53A and the fixing holes 22A. Accordingly, a mounting error of the ground terminal 50 can be detected at latest when the connector 10 is mounted in the shielded casing C. Of course, the error also can be detected visually and/or automatically before mounting of the connector 10.

The shielding terminal 15 may need to be withdrawn from the housing 20 for maintenance. Thus, a jig is inserted into a disengaging recess 21A at the bottom of the housing 20 to push the bottom wall 51 of the ground terminal 50 down to the outside. The ground terminal 50 then is returned to the partial locking position. Further, a jig may be inserted from the front of the connector 10 to cancel locking by the lock 25. In this way, the contact pieces 56 are brought back to the retracted position, and a resistance that acts during withdrawal of the ground terminal 15 can be small.

The contact pieces 56 of the ground terminal 50 are movable between the retracted position and the contact portion and can be locked at the respective positions. Additionally, the shielding terminal 15 can be inserted into the housing 20 at the retracted position where the contact pieces 56 and the shielding terminal 15 do not interfere with each other. Thus, an insertion resistance of the shielding terminal 15 can be reduced. Further, since the movements of the contact pieces 56 from the retracted positions to the contact positions are linked with the movement of the ground terminal 50 from the partial locking position to the full locking position, the number of operation steps performed for assembling the connector can be reduced. Therefore, an assembling operability of the connector 10 can be improved.

The connector 10 preferably doubly locks the shielding terminal 15 with partial locking achieved by the lock 25 of the cavity 21 and full locking achieved by the touching pieces 59 of the ground terminal 50. Further, since the ground terminal 50 is mounted in a direction that intersects the insertion direction of the shielding terminal 50 into the housing 20, the shielding terminal 15 can be securely locked so as not to come out.

The shielding terminal 15 can be mounted after the housing 20 and the ground terminal 50 are assembled into an integral unit by mounting the ground terminal 50 at the partial locking position with respect to the housing 20. Accordingly, it is not necessary to hold the housing 20 and the ground terminal 50 separately.

The contact pieces 56 are between the bottom wall 51 and the engaging pieces 57 in the ground terminal 50. Thus, they are protected from deformation by contact another member during assembling or by contact with an operator.

Beams for photoelectric detection can be passed along the detection grooves 28 to check the position of the contact leading end portions 56A of the contact pieces 56 of the ground terminal 50. Thus, defective products in which the contact pieces 56 are displaced from their proper positions can be left out before shipment.

The present invention is not limited to the above described and illustrated embodiment. For example, following embodiments are also embraced by the technical scope of the present invention as defined in the claims. Beside the following embodiments, various changes can be made without departing from the scope and spirit of the present invention as defined in the claims.

Although the male shielding terminal 15 is used in the foregoing embodiment, a female shielding terminal may be used.

The movements of the contact pieces from the retracted positions to the contact positions are linked with the movement of the ground terminal 50 from the partial locking position to the full locking position in the foregoing embodiment. However, the contact pieces may be pushed to the contact positions by, for example, a retainer mounted on the housing.

Although the contact pieces are formed integral or unitary to the ground terminal in the foregoing embodiment, the ground terminal and the contact pieces may be formed separately.

What is claimed is:

1. A connector (10) for fixing a shielding terminal (15) to an electrically conductive fixed article (C), the shielding terminal (15) having a shielding shell (16) surrounding an inner terminal, the connector (10) comprising a housing (20), a ground terminal (50) assembled with the housing (20) and being configured for electrically contacting the fixed article (C), the ground terminal (50) comprising at least one contact piece (56), the ground terminal (50) being movable on the housing (20) between a first position where the contact piece (56) is not in contact with the shielding shell (16) and a second position where the contact piece (56) is in contact with the shielding shell (16) for grounding the shielding shell (16) to the fixed article (C).

2. The connector of claim 1, wherein the housing (20) and the ground terminal (50) each are formed with a mount hole (22A, 53A) through which a mounting member (B) is insertable to fix the connector (10) to the fixed article (C).

3. The connector of claim 2, wherein the mount hole (22A) of the housing (20) and the mount hole (53A) of the ground terminal (50) are not aligned when the ground terminal (50) is at the first position while being substantially aligned when the ground terminal (50) is at the second position.

4. The connector of claim 3, wherein a leading end portion (56A) of the contact piece (56) is exposed at a position detectable from outside the housing (20) when the ground terminal (50) is at the first position.

5. The connector of claim 3, wherein the leading end portion (56A) is arranged in a corresponding detection portion (28) of the housing (20) when the ground terminal (50) is at the first position.

6. The connector of claim 5, wherein the housing (20) has a cavity (21) into which the shielding terminal (15) is insertable, and wherein the contact piece (56) comprises a slanted portion projecting towards the cavity (21).

7. The connector of claim 6, wherein the housing (20) comprises a slanted surface (33A) corresponding to the slanted portion of the contact piece (56) and having a substantially identical inclination as the slanted portion.

8. The connector of claim 1, wherein the ground terminal (50) comprises full locking means for locking the shielding terminal (15) in the housing (20) when the ground terminal (50) is in the second position on the housing (20).

9. The connector of claim 8, wherein the housing (20) is formed with partial locking means (25) for partly locking the shielding terminal (15) in the housing (20) and for supplementing the full locking means of the ground terminal (50).

10. The connector of claim 9, wherein the ground terminal (50) is configured to permit insertion and withdrawal of the shielding terminal (15) into the housing (20) when the ground terminal is in the first position (FIG. 14).

11. A method for mounting a connector (10) to an electrically conductive fixed article (C), comprising:

providing a housing (20);

providing a shielding terminal (15) with an inner terminal and a shielding shell (16) surrounding the inner terminal;

providing a ground terminal (50) configured for mounting on the housing (20) and for electrically contacting the fixed article (C), the ground terminal (50) having at least one contact piece (56) formed thereon;

mounting the ground terminal (50) in a first position on the housing (20);

inserting the shielding terminal (15) into the housing (20); and moving the ground terminal (50) to a second position on the housing (20) such that the contact piece (56) is brought into contact with the shielding shell (16) and shorts the shielding shell (16) to the fixed article (C).

12. The method of claim 11, further comprising the step of inserting a mounting member (B) through a mount hole (22A, 53A) respectively formed in both the housing (20) and the ground terminal (50) to fix the connector (10) to the fixed article (C).

13. The method of claim 12, wherein the mount hole (22A) of the housing (20) and that (53A) of the ground terminal (50) are not aligned when the ground terminal (50) is at the first position while being substantially aligned when the ground terminal (50) is at the second position.

14. The method of claim 13, further comprising a step of detecting whether the contact piece (56) is in contact with the shielding shell (16) by verifying whether a portion (56A) of the contact piece (56) is arranged in a detecting portion (28) of the housing (20).

* * * * *